US010173316B2

(12) United States Patent
Vaughn

(10) Patent No.: US 10,173,316 B2
(45) Date of Patent: Jan. 8, 2019

(54) MARKING STYLUS FOR AUTOMATED MARKING SYSTEMS

(71) Applicant: Wolfram Labs, LLC, Groveport, OH (US)

(72) Inventor: Joel Michael Vaughn, Groveport, OH (US)

(73) Assignee: Wolfram Labs, Inc., Groveport, OH (US)

( * ) Notice: Subject to any disclaimer, the term of this patent is extended or adjusted under 35 U.S.C. 154(b) by 230 days.

(21) Appl. No.: 15/052,918

(22) Filed: Feb. 25, 2016

(65) Prior Publication Data

US 2016/0250748 A1 Sep. 1, 2016

Related U.S. Application Data

(60) Provisional application No. 62/121,149, filed on Feb. 26, 2015.

(51) Int. Cl.
*B25H 7/04* (2006.01)
*B44C 1/22* (2006.01)

(52) U.S. Cl.
CPC ..... *B25H 7/04* (2013.01); *B44C 1/22* (2013.01)

(58) Field of Classification Search
CPC .. B25H 7/04; B25H 7/045; B44C 1/22; B44C 1/222; B44C 1/224
USPC ..... 33/18.1, 26; 81/9.2
See application file for complete search history.

(56) References Cited

U.S. PATENT DOCUMENTS

| | | | | |
|---|---|---|---|---|
| 3,138,875 A | | 6/1964 | Christensen | |
| 4,109,737 A | | 8/1978 | Bovenkerk | |
| 4,506,999 A | | 3/1985 | Robertson | |
| 5,316,397 A | | 5/1994 | Robertson et al. | |
| 5,697,994 A | | 12/1997 | Packer et al. | |
| 6,135,350 A | * | 10/2000 | White et al. | B44B 3/061 235/380 |
| 6,478,206 B2 | * | 11/2002 | Shimotoyodome et al. | C03B 33/10 225/2 |
| 6,671,965 B2 | | 1/2004 | Clemens et al. | |
| 7,191,529 B2 | | 3/2007 | Phipps et al. | |
| 7,926,184 B2 | | 4/2011 | Clemens | |
| 7,932,199 B2 | | 4/2011 | McHale, Jr. et al. | |
| 8,359,756 B2 | | 1/2013 | Soyama | |
| 2010/0154614 A1 | * | 6/2010 | Liao et al. | B26D 7/086 83/880 |

FOREIGN PATENT DOCUMENTS

| | | | | |
|---|---|---|---|---|
| GB | 288871 A | * | 4/1928 | G01B 3/20 |
| JP | 52130568 A | * | 11/1977 | C03B 33/10 |
| JP | 06190610 A | * | 7/1994 | B23B 27/20 |
| JP | 2006007677 A | * | 1/2006 | B28D 5/00 |
| JP | 2014004812 A | * | 1/2014 | B28D 5/00 |

* cited by examiner

*Primary Examiner* — R. A. Smith

(74) *Attorney, Agent, or Firm* — Jason H. Foster; Kremblas & Foster

(57) ABSTRACT

A marking stylus for use in automated marking systems with one of the following superabrasive components as the scribing tip: polycrystalline diamond or polycrystalline cubic boron nitride. The superabrasive may have one or more chamfers, as well as a sharp, rounded, or blunt tip. The superabrasive is preferably attached to the body of the stylus by one of the following methods: brazing, press fit, shrunk fit, clamped, casted, injection molded, or a high pressure high temperature cycle.

3 Claims, 3 Drawing Sheets

MARKING STYLUS FOR AUTOMATED MARKING SYSTEMS

CROSS-REFERENCES TO RELATED APPLICATIONS

This application claims the benefit of U.S. Provisional Application No. 62/121,149 filed Feb. 26, 2015. This prior application is hereby incorporated by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

The present invention relates generally to the field of marking systems and, more specifically, to a scribe and/or dot peen stylus technology for automated marking.

The scribe and dot peen styluses used in automated marking are replaceable tools used to place markings on objects by deforming the surface of the object. When a scribing system is used, the tip of the stylus is first caused to contact the surface of the object by mechanical, rather than manual (hand or other human limb), means. Mechanical means includes, without limitation, a solenoid, air cylinder, or other mechanical means that can displace physical objects along lines and/or curves in two and/or three dimensions. Once the tip of the stylus engages the surface, the stylus is then dragged along the surface for a predetermined distance to generate the desired mark. The terms "drag", "dragged", "drug", and any derivatives thereof are defined herein to mean maintaining contact between the scribing tip of the scribe stylus and the surface to be marked while the scribing tip of the scribe stylus is displaced relative to the surface along one or more lines and/or curves while a force is applied to the scribe stylus sufficient to seat the tip against the surface and cause markings in the surface where the scribing tip makes contact. The stylus is then removed from the surface. The steps of the tip contacting the object's surface and applying a force, dragging, and removing the tip from the surface are repeated until the desired surface markings are generated.

For dot peen marking the stylus is caused to contact the surface of the object by mechanical, rather than manual (hand or other human limb), means with sufficient force to make a mark. Mechanical means includes, without limitation, a solenoid, air cylinder, or other mechanical means that can displace physical objects along lines and/or curves in two and/or three dimensions with sufficient force to deform the surface at the point of impact. Once the tip of the stylus engages the surface and makes a mark, the stylus is then removed from the surface. This process is repeated, thereby leaving one or more indentations on the surface without dragging the tip against the surface.

Neither stylus is intended to remove substantial material to make the markings, but rather the stylus modifies the surface, such as by deforming the material at the surface adjacent the tip. Nevertheless, an insubstantial amount of material may be removed during the act of scribing, even though material removal is not the intended or primary means of marking. Thus, stylus marking is to be distinguished from machining or engraving, in which the primary mode of marking is by intentionally removing material from the substrate by a high speed, and typically rotating, bit or tool. The application of scribing is not typically considered as mechanically demanding as machining, engraving, and/or other metal working processes, because little to no material is removed by either stylus during scribing. Furthermore, the relative velocity of the stylus to the surface being marked is substantially lower during the dragging portion of scribing than the relative velocity of machining tools, such as a lathe cutting bit or drill bit during the marking portion of engraving or machining. However, as scribing speeds increase and the number of parts marked per tip increases, so does tip wear and the total number of impacts the tip sustains. Likewise, the continual impact in dot peen marking is very demanding on the tip material, especially with deeper marks and the use on harder substrate materials. As the use of scribed and dot peen markings increases, so will the need for more advanced styluses.

The process of dot peening and the process of contact, dragging and removal is repeated over and over to modify the surface for many objects, including identification markings such as text, pictures, and barcodes. Many scribe and dot peen styluses suffer from premature failure and short lifetimes due to the rigorous circumstances such styluses are subjected to. Scribe styluses are driven in a variety of methods to make initial contact, and then are dragged across the material's surface to leave markings, as is described in U.S. Pat. No. 7,191,529, which is incorporated herein by reference. Dot peen styluses are driven in a variety of methods to make contact with the material's surface and leave markings, as described in U.S. Pat. No. 4,506,999 and U.S. Pat. No. 5,316,397, which are incorporated herein by reference.

Current state of the art scribes and dot peen styluses that have single crystal diamond tips, as described in U.S. Pat. Nos. 7,926,184; 6,671,965; and 7,191,529, are used for marking on hard substrates where more traditional materials like cemented tungsten carbide or tool steel would fail rapidly and leave poor quality marks. These styluses are made by brazing a single crystal of diamond onto the tip. The braze has some chemical means of attachment, but the diamond is predominantly held in place by braze material that envelopes the diamond, thus providing a mechanical grabbing or enclosing of the crystal as described in U.S. Pat. No. 3,138,875. Because of the containment mechanism, these styluses have a tendency to break upon repeated impacts, pull out of the stylus, and wear rapidly when used to form markings on hard surfaces, such as on ferrous metals and titanium. This results in costly down time, repairs, damaged materials, and the possibility of unmarked parts.

Therefore, it can be seen that there is a need for an improved scribe and dot peen styluses that are tougher, wear slower, and resist pullouts.

BRIEF SUMMARY OF THE INVENTION

In one aspect, an automated marking stylus comprises a polycrystalline diamond tip. This tip is attached to a body of the stylus by one of many known attachment means, including, without limitation, physical clamping, press fitting, shrink fitting, brazing, casting, adhesives, being molded into, high pressure high temperature reattachment, and/or sintering and attachment simultaneously in a high pressure, high temperature apparatus.

In another aspect, an automated marking stylus comprises a polycrystalline diamond tip. This tip is prepared in such a way that it is backed by cemented tungsten carbide. This tip is attached to the body of the stylus in any of the above-described attachment means.

In another aspect, an automated marking stylus comprises a polycrystalline cubic boron nitride (CBN) tip. This tip is attached to the body of the stylus in any of the above-described attachment means.

In another aspect, an automated marking stylus comprises a polycrystalline cubic boron nitride tip. This tip is prepared in such a way that it is backed by cemented tungsten carbide. This tip is attached to the body of the stylus in any of the above-described attachment means.

The polycrystalline superabrasive may have a grain size that ranges from about 0.1 microns to about 200 microns, and may preferably be no larger than about 500 microns.

These and other features, aspects and advantages of the present invention will become better understood with reference to the following drawings, description and claims.

The invention of polycrystalline superabrasives and their use in industry has proven to increase toughness and wear of cutting edges in oil and gas drilling, machining, and wood working. These materials are made in high pressure and high temperature apparatuses to create bonds between individual diamond crystals or individual cubic boron nitride (CBN) crystals. U.S. Pat. Nos. 4,109,737; 5,697,994; and 7,932,199 are examples of such technology, and are incorporated herein by reference.

Polycrystalline superabrasives differ from their single crystalline counterparts in both physical structure and, in many cases, performance. Polycrystalline superabrasives are single bodies of many smaller superabrasives, such as millions of diamond particles, sintered to form a single polycrystalline body. They typically include a catalyst that is the same as that of a backing material, such as cobalt in the case of diamond backed by cemented tungsten carbide, incorporated throughout the body of the polycrystalline material. This compact of many crystals is thus molecularly connected due to the steps of going through the sintering process. Additionally, the compact is intimately attached to the backing material by a continuous web of catalyst material throughout both the polycrystalline material and the backing material. This allows for vastly improved retention, because the polycrystalline diamond is not attached by a single lip of braze enclosing a single crystal, but rather by millions of tortuous "fingers" of metallic binder extending between each small particle. These polycrystalline superabrasive materials offer similar hardness to that of a single crystal of the same particle material, but typically are much tougher than their single crystalline counterparts. This toughness has been demonstrated in many machining and oil and gas drilling applications. The process of making polycrystalline superabrasives also allows for different shapes to be realized that would be much more difficult with single crystals, such as long rods, flat discs, and complex surface features.

The grain size of the polycrystalline material is the size distribution of the individual crystals that make up the entire polycrystalline compact. The grain size distribution and maximum size can change product performance depending upon the application. In some applications a finer grain size distribution can prove to have greater impact resistance, whereas in other situations a larger grain size may prove tougher. Other situations call for a wider distribution of grain sizes. This varies depending upon the material being engaged and the manner of engagement. The many grains of diamond or cubic boron nitride (CBN) in a given polycrystalline superabrasive compact provide many scattering points. In a single crystal, the weakest singularity determines the net durability of the entire diamond. But in a polycrystalline superabrasive, one weak crystal can be supported by the surrounding stronger crystals, resulting in a very tough material.

When dealing with ferrous substrate materials such as steel or even titanium, CBN might be better suited over diamond. Diamond, even in polycrystalline form can wear more quickly on ferrous material than cubic boron nitride. This is a result of chemical interactions with the diamond and the substrate. Much like polycrystalline diamond, polycrystalline cubic boron nitride has benefits of toughness, adhesion, and shaping.

There are some scribing machines that utilize polycrystalline diamond wheels to create scoring marks. These machines are used to score brittle materials such as glass in order to crack the material along the score mark. These devices are not, to Applicant's knowledge, used for applying identifiable markings, such as barcodes, text, and pictures. This is primarily because it is difficult to "draw" with a wheel as opposed to a single point. U.S. Pat. No. 8,359,756 discloses technology that relates to such machines, and is incorporated herein by reference.

Figure 1:
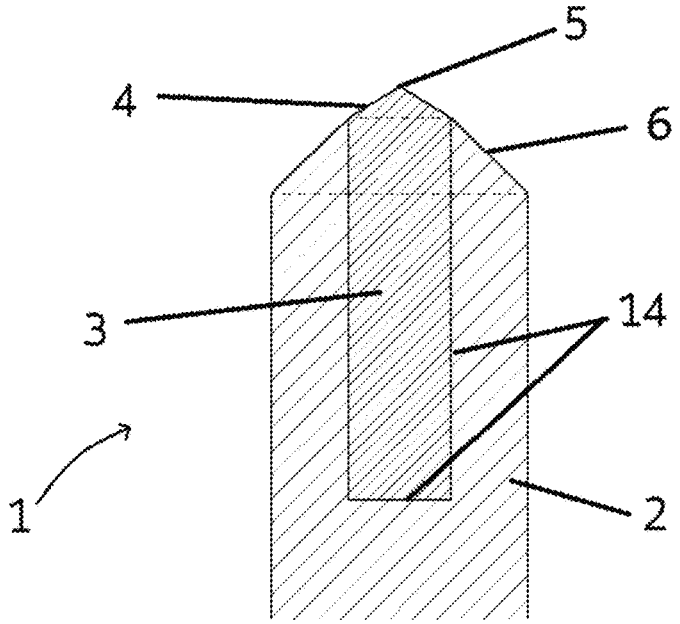
FIG. 1 is a schematic cross-sectional view through the lines A-A of FIG. 5 illustrating an automated marking stylus in accordance with an embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional Application No. 62/121,149 filed Feb. 26, 2015 is incorporated in this application by reference. The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims. Various inventive features are described below that can each be used independently of one another or in combination with other features. Broadly, embodiments of the present invention provide an automated marking stylus capable of being introduced to a material's surface and then removed, or dragged to mark the material's surface before removal.

Referring now to FIG. 1, an automated marking stylus assembly 1 may generally include a body 2 containing and supporting a member of polycrystalline superabrasive 3 such as polycrystalline diamond or polycrystalline cubic boron nitride (CBN). The material of body 2 may be made of metal, cemented tungsten carbide, plastic, glass, ceramic or any other suitable material or combination of materials, such as in a composite material, depending upon the needs of a given application as the person of ordinary skill will understand from the description herein. As shown, the polycrystalline superabrasive 3 may extend deep into the body 2, which can be helpful with retention of the superabrasive if the stylus experiences extreme side loading.

The assembly 1 is typically substantially longer than it is wide, and the outer surface of the body 2 may be circular cylindrical, although this is determined by the machine in which the assembly 1 is to be held. The assembly 1 has an outer shape that may be received by the machine that will hold the assembly 1. The polycrystalline superabrasive 3 may have a circular cylindrical outer shape that fits tightly within a complementary circular cylindrical bore formed in the body 2. The stylus 1 may contain a chamfer 6 on the body 2 and a chamfer 4 on the portion of polycrystalline superabrasive 3 that protrudes from the body 2. The chamfers 4 and 6 may be formed by abrading the body 2 and the polycrystalline superabrasive 3, or by forming the body 2 and the polycrystalline superabrasive 3 with the chamfered shape. Each chamfer is a surface that is at an acute angle relative to the longitudinal axis of the body 2 and/or the polycrystalline superabrasive 3, and permits the terminal end of the assembly 1 to contact a substrate's surface at a localized point without peripheral portions of the assembly 1 contacting the surface. The polycrystalline superabrasive 3 may have a sharp tip 5 at the end of the chamfer 4 to further localize the contact.

The interface 14 between the polycrystalline superabrasive 3 and the body 2 constrains the polycrystalline superabrasive 3 in such a way that it remains attached to the body 2. This interface 14 may be the surface of contact between the body 2 and the superabrasive 3, as in the case of a friction fit, or it may be a third material inserted between the body 2 and the polycrystalline superabrasive 3 that contacts both the body 2 and the polycrystalline superabrasive 3. In the former, the interface 14 may be formed by press fitting the polycrystalline superabrasive 3 in the body 2, by shrink fitting the polycrystalline superabrasive 3 in the body 2, by casting the body 2 around the polycrystalline superabrasive 3, by molding the polycrystalline superabrasive 3 into the body 2, or by physically clamping the polycrystalline superabrasive 3 in the body 2 with a clamping mechanism (not shown). In the latter, the polycrystalline superabrasive 3 is held in the body 2 by a third material by brazing, gluing (adhering) or otherwise interposing a third material between the body 2 and the polycrystalline superabrasive 3. Additionally, the interface 14 may be a result of combining the polycrystalline superabrasive 3 to the body 2 through a high pressure, high temperature cycle, or by sintering the polycrystalline superabrasive 3 within the body 2 through a high pressure, high temperature cycle. For example, the polycrystalline superabrasive 3 can be deposited, such as by one of many vapor deposition processes, within the body 2, or the body can be deposited around the polycrystalline superabrasive 3.

Figure 2:
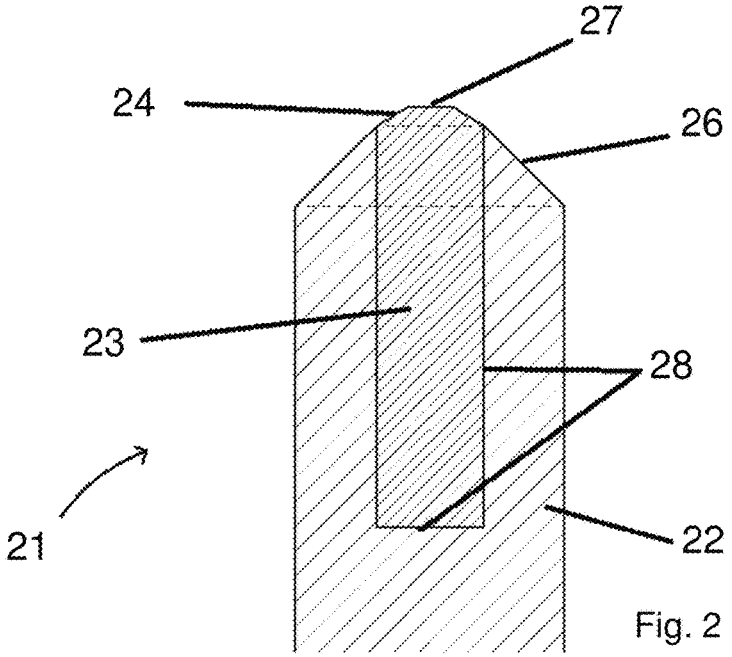
FIG. 2 is a schematic cross-sectional view illustrating an automated marking stylus in accordance with another embodiment of the present invention.

As shown in FIG. 2, an automated marking stylus assembly 21 may generally include a body 22 containing and supporting a member of polycrystalline superabrasive 23 such as polycrystalline diamond or polycrystalline cubic boron nitride. The stylus assembly 21 may contain a chamfer 26 on the body 22 and a chamfer 24 on the portion of polycrystalline superabrasive 23. The polycrystalline superabrasive may have a blunt tip 27. The body 22 and polycrystalline superabrasive 23 may have shapes similar to those described for the above embodiment(s), may be attached to one another in any of the ways described for the above embodiment(s), and may have an interface 28 similar to those described above.

Figure 3:
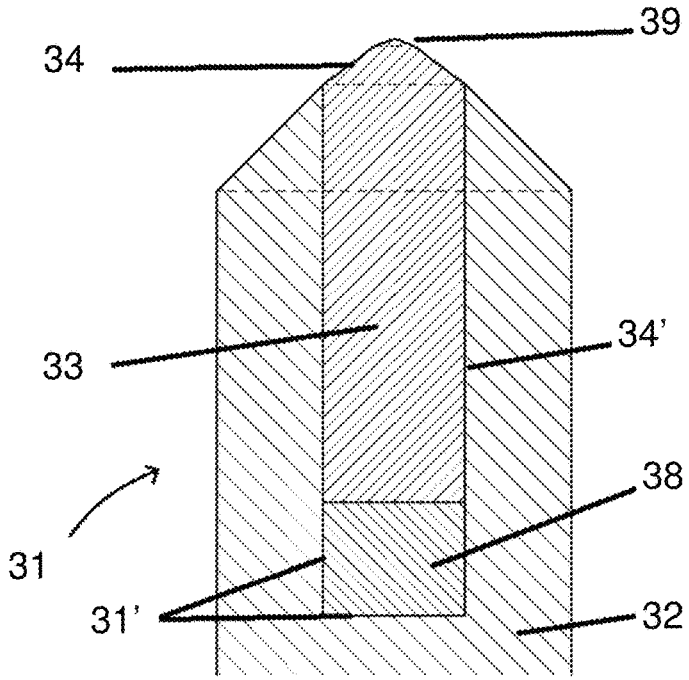
FIG. 3 is a schematic cross-sectional view illustrating an automated marking stylus in accordance with yet another embodiment of the present invention.

As shown in FIG. 3, an automated marking stylus assembly 31 may generally include a body 32 containing and supporting a member of polycrystalline superabrasive 33 such as polycrystalline diamond or polycrystalline cubic boron nitride. The polycrystalline superabrasive 33 may be intimately combined with a portion of backing material 38 used in the sintering and manufacturing of the polycrystalline superabrasive 33. The backing material 38 may be made of cemented tungsten carbide or any other suitable material. The interface 31' between the backing material 38 and the body 32 may be formed, as described above for the interface 34', by press fitting, shrink fitting, brazing, casting, gluing, being molded into, and/or physically clamping with a mechanism (not shown).

As also shown in FIG. 3, the exposed polycrystalline superabrasive 33 may have more than one chamfer 34 and 39, and it will be understood that any number of chamfers is possible and contemplated. Additionally, the body 32 may have more than one chamfer (not shown) as will be understood. The body 32 and polycrystalline superabrasive 33 may have shapes similar to those described for the above embodiment(s), may be attached to one another in any of the ways described for the above embodiment(s), and may have an interface similar to those described above.

Figure 4:
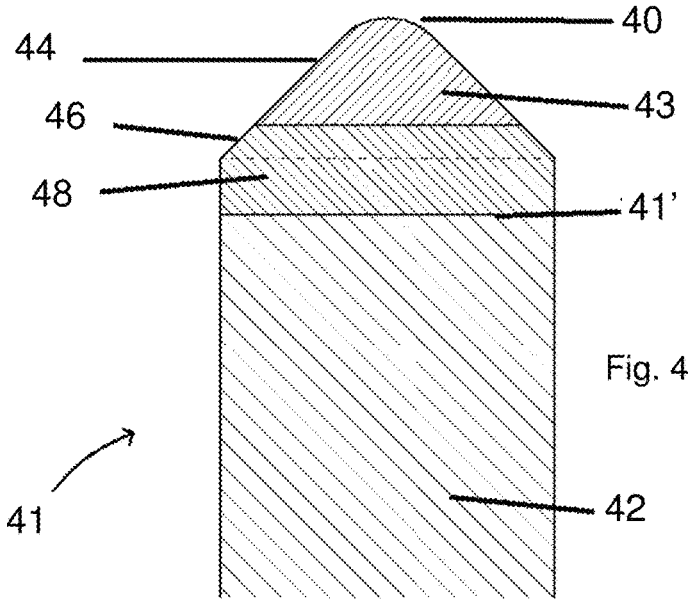
FIG. 4 is a schematic cross-sectional view illustrating an automated marking stylus in accordance with another embodiment of the present invention.

As shown in FIG. 4, an automated marking stylus assembly 41 may generally include a body 42 containing and supporting a member of polycrystalline superabrasive 43 such as polycrystalline diamond or polycrystalline cubic boron nitride. A backed polycrystalline superabrasive 43 may be attached to the body 42 by only the interface 41' between a backing 48 and the body 42. The backing 48 may have a chamfer 46. The assembly 41 may contain a chamfer 44 on the portion of polycrystalline superabrasive 43 that protrudes from the body 42. The backing 48 is intimately connected to the superabrasive 43 via numerous "fingers" of catalyst material from the backing 48 that has been incorporated into the superabrasive 43 during their manufacturing process. The polycrystalline superabrasive may have a rounded tip 40. The body 42 and polycrystalline superabrasive 43 may have shapes similar to those described for the above embodiment(s), may be attached to one another in any of the ways described for the above embodiment(s), and may have an interface similar to those described above.

Figure 5:
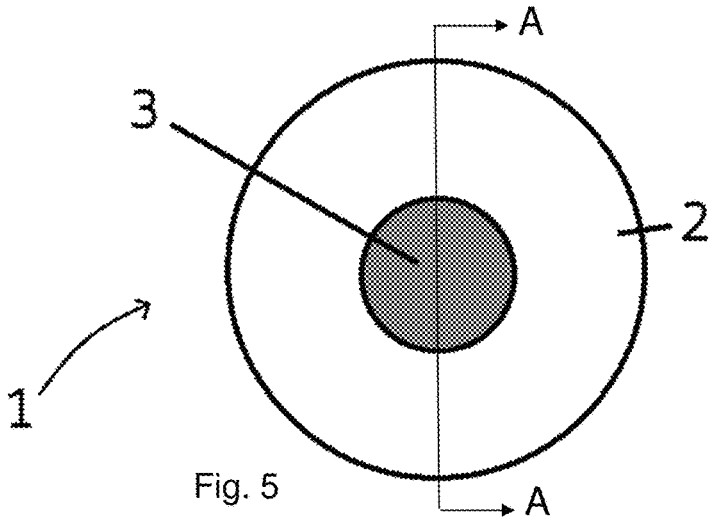
FIG. 5 is a schematic top view illustrating an automated marking stylus in accordance with the embodiment of FIG. 1.

As shown in FIG. 5 in the view of the end of the assembly 1 shown in FIG. 1, the polycrystalline superabrasive 3 may be round in cross section to form a circular cylinder. It is to be noted that the polycrystalline superabrasive 3 may alternatively have a non-round exterior shape (not shown), for example, such as a square, triangle, oval, polygon, or cross, and it is preferred that, even with a non-round shape, the superabrasive 3 is preferably cylindrical. Even if the superabrasive 3 is circular cylindrical, non-circular cylindrical or any other shape, it is preferred that the body 2 have an exterior shape that conforms to the interior of the machine that holds the assembly 1. As shown in FIG. 5, the body 2 may be formed entirely around the superabrasive 3 on the long sides of the assembly 1.

Figure 6:
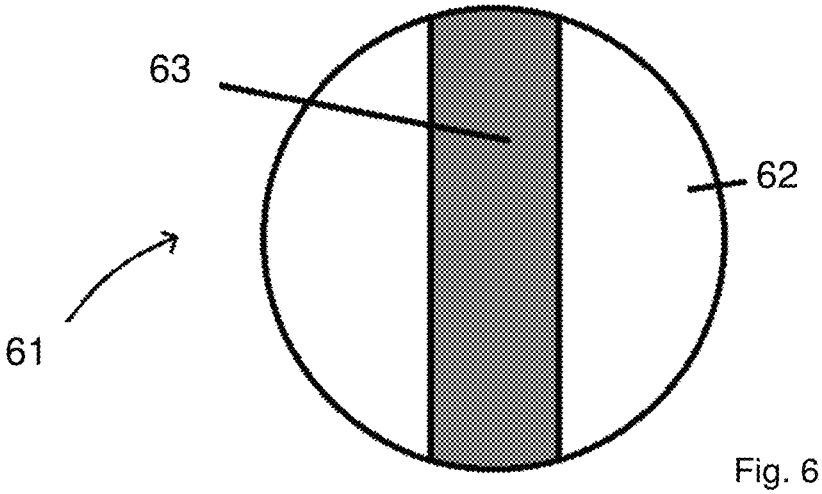
FIG. 6 is a schematic top view illustrating an automated marking stylus in accordance with another embodiment of the present invention.

As shown in the end view of FIG. 6, an automated marking stylus assembly 61 may generally include a body 62 containing and supporting a member of polycrystalline superabrasive 63 such as polycrystalline diamond or polycrystalline cubic boron nitride. A polycrystalline superabrasive 63 may extend to the long edges of the body 62 in one or more, such as opposing, portions of the body 62. This can be accomplished by sandwiching two body 62 segments on opposite sides of a substantially planar strip of superabrasive 63. The body 62 and polycrystalline superabrasive 63 may have shapes similar to those described for the above embodiment(s), may be attached to one another in any of the ways described for the above embodiment(s), and may have an interface similar to those described above.

In a preferred embodiment of the invention, the marking stylus is grasped, clamped or otherwise retained in a moving component of an automated marking machine, such as an "arm". The machine displaces the pointed tip of the stylus, which tip is made of polycrystalline superabrasive, toward and into contact with the substrate to be marked. This substrate may be a metal or plastic (or any other material) panel, plate or other body. The force of the arm moving the stylus toward and into contact with the substrate is sufficient to cause the preferably pointed tip to strike the substrate and deform the substrate's material sufficiently to make a desired mark. The toughness of the polycrystalline superabrasive compact greatly reduces the likelihood of damage to the stylus. The tip makes a mark that may be left at the mark made upon initial impact, or the mark can be extended by simply dragging the tip of the stylus along the surface of the substrate while maintaining a force that continues a degree of deformation. Once the mark is sufficient, the arm draws the stylus away from the substrate and prepares for another movement back to the substrate or to another, different substrate.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A method of automated marking of a metal substrate using a marking stylus, the method comprising:

(a) affixing a body to a polycrystalline superabrasive compact having a pointed tip that extends away from the body;

(b) retaining the body in an automated marking apparatus with the tip facing the substrate;

(c) moving the tip into contact with the substrate with sufficient force to deform the substrate; and (d) displacing at least the tip relative to the substrate while applying a force to the body sufficient to deform the substrate, thereby dragging the tip along the substrate.

2. The method in accordance with claim 1, further comprising moving the tip away from contact with the substrate after dragging the tip along the substrate.

3. The method in accordance with claim 1, further comprising a step of moving the tip into contact with the substrate immediately followed by moving the tip away from contact with the substrate without any substantial dragging of the tip along the substrate.

* * * * *